US008879964B1

(12) United States Patent
Buchanan et al.

(10) Patent No.: US 8,879,964 B1
(45) Date of Patent: Nov. 4, 2014

(54) TONER CARTRIDGE HAVING AN ANGLED EXIT PORT SURFACE

(71) Applicant: Lexmark International, Inc., Lexington, KY (US)

(72) Inventors: John Andrew Buchanan, Paris, KY (US); James Anthany Carter, II, Lexington, KY (US); Gregory Alan Cavill, Winchester, KY (US); Matthew Lee Rogers, Lexington, KY (US); Christopher Gene Vowels, Boston, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/845,406

(22) Filed: May 16, 2013

(51) Int. Cl.
*G03G 15/08* (2006.01)

(52) U.S. Cl.
CPC ..... *G03G 15/0867* (2013.01)
USPC ..... 399/260; 399/258

(58) Field of Classification Search
USPC ..... 399/260
See application file for complete search history.

(56) References Cited

U.S. PATENT DOCUMENTS 5,083,158 A 1/1992 Kashima et al.
5,587,777 A * 12/1996 Miyaji et al. ..... 399/120
5,608,501 A 3/1997 Makino
5,758,233 A 5/1998 Coffey et al.
5,768,661 A 6/1998 Coffey et al.
6,014,536 A 1/2000 Ban et al.
6,128,453 A 10/2000 Ban et al.
6,259,874 B1 7/2001 Murakami et al.
6,266,505 B1 7/2001 Ban et al.
6,594,458 B2 7/2003 Ban et al.
6,771,922 B2 8/2004 Blanck et al.
6,782,219 B2 8/2004 Yoshino et al.
6,792,228 B2 9/2004 Ban et al.
6,853,828 B2 2/2005 Ban et al.
6,968,139 B2 11/2005 Ban et al.
6,978,101 B2 12/2005 Ban et al.

(Continued)

OTHER PUBLICATIONS

International Search Report and Written Opinion of the International Searching Authority dated Feb. 1, 2013 for PCT Application No. PCT/US12/65148 (7 pages).

(Continued)

*Primary Examiner* — Clayton E Laballe
*Assistant Examiner* — Jas Sanghera
(74) *Attorney, Agent, or Firm* — Justin M Tromp

(57) ABSTRACT

A toner cartridge for an electrophotographic image forming device according to one example embodiment includes a housing having a top, a bottom, a front, and a rear positioned between a first side and a second side of the housing. The housing has an elongated shape extending from the first side to the second side. The housing defines a reservoir for containing toner therein. An exit port on the front of the housing is in fluid communication with the reservoir. A port surface surrounding the exit port is positioned to seal against a corresponding surface when the toner cartridge is installed in the image forming device. The port surface is angled upward with respect to the bottom of the housing and faces generally downward.

20 Claims, 9 Drawing Sheets

(56) References Cited

U.S. PATENT DOCUMENTS

| | | | | |
|---|---|---|---|---|
| 6,999,704 | B2 * | 2/2006 | Hayashi et al. | 399/258 |
| 7,272,336 | B1 | 9/2007 | Dawson et al. | |
| 7,386,250 | B2 | 6/2008 | Ban et al. | |
| 7,548,710 | B2 | 6/2009 | Gayne et al. | |
| 7,606,520 | B2 | 10/2009 | Dawson | |
| 8,165,505 | B2 | 4/2012 | Kojima | |
| 2003/0223775 | A1 | 12/2003 | Yoshino et al. | |
| 2006/0067725 | A1 | 3/2006 | Miyabe et al. | |
| 2006/0140664 | A1 | 6/2006 | Takami | |
| 2006/0171744 | A1 | 8/2006 | Ikeda et al. | |
| 2007/0212118 | A1 | 9/2007 | Nagae et al. | |
| 2007/0223965 | A1 | 9/2007 | Takagi | |
| 2008/0101821 | A1 | 5/2008 | Gayne et al. | |
| 2009/0142103 | A1 | 6/2009 | Chaudhuri et al. | |
| 2010/0221039 | A1 | 9/2010 | Kawai et al. | |

OTHER PUBLICATIONS

International Search Report and Written Opinion of the International Searching Authority dated Jan. 31, 2013 for PCT Application No. PCT/US12/65149 (7 pages).

International Search Report and Written Opinion of the International Searching Authority dated Jan. 31, 2013 for PCT Application No. PCT/US12/65152 (6 pages).

International Search Report and Written Opinion of the International Searching Authority dated Jan. 28, 2013 for PCT Application No. PCT/US12/65147 (12 pages).

Co-pending U.S. Appl. Nos. 13/340,876, 13/340,881, 13/340,884, 13/340,911 and U.S. Appl. Nos. 13/340,935, filed Dec. 30, 2011 and U.S. Appl. Nos. 13/780,060 and 13/780,042, filed Feb. 28, 2013.

* cited by examiner

TONER CARTRIDGE HAVING AN ANGLED EXIT PORT SURFACE

CROSS REFERENCES TO RELATED APPLICATIONS

None

BACKGROUND

1. Field of the Disclosure

The present disclosure relates generally to toner cartridges used in electrophotographic image forming devices and, more particularly, to a toner cartridge having an angled exit port surface.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges. As a result, in systems utilizing a separate toner cartridge and imaging unit, the toner cartridge is often referred to as a "toner bottle" even though the toner cartridge is more complex than a mere bottle for holding toner.

In devices utilizing a separate toner cartridge and imaging unit, toner is fed from an exit port on the toner cartridge into an entrance port on the imaging unit. It is important that the exit port on the toner cartridge and the entrance port on the imaging unit are precisely aligned. If the exit port on the toner cartridge is misaligned with the entrance port on the imaging unit, severe toner leakage may occur resulting in mechanical and print quality defects. The requirement for precise alignment must be balanced with the need to permit the user to easily load and unload the imaging unit and the toner cartridge into and out of the image forming device.

SUMMARY

A toner cartridge for an electrophotographic image forming device according to one example embodiment includes a housing having a top, a bottom, a front, and a rear positioned between a first side and a second side of the housing. The housing has an elongated shape extending from the first side to the second side. The housing defines a reservoir for containing toner therein. An exit port on the front of the housing is in fluid communication with the reservoir. A port surface surrounding the exit port is positioned to seal against a corresponding surface when the toner cartridge is installed in the image forming device. The port surface is angled upward with respect to the bottom of the housing and faces generally downward.

A toner cartridge for an electrophotographic image forming device according to another example embodiment includes a housing having a top, a bottom, a front, and a rear positioned between a first side and a second side of the housing. The housing has an elongated shape extending from the first side to the second side. The housing defines a reservoir for containing toner therein. A rotatable shaft is positioned within the reservoir and extends between the first side and the second side. At least one agitator extends from the rotatable shaft for agitating toner within the reservoir. A channel open to the reservoir and positioned on the front of the housing extends between the first side and the second side. An exit port on the front of the housing is in fluid communication with the channel. A rotatable auger is positioned along a length of the channel for moving toner from the reservoir to the exit port. A port surface surrounding the exit port is positioned to seal against a corresponding surface when the toner cartridge is installed in the image forming device. The port surface is angled with respect to a line formed by a centerline of the rotatable shaft and a centerline of the rotatable auger by between about 3 degrees upward with respect to the line and about 14 degrees downward with respect to the line. The port surface is angled upward with respect to the bottom of the housing.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
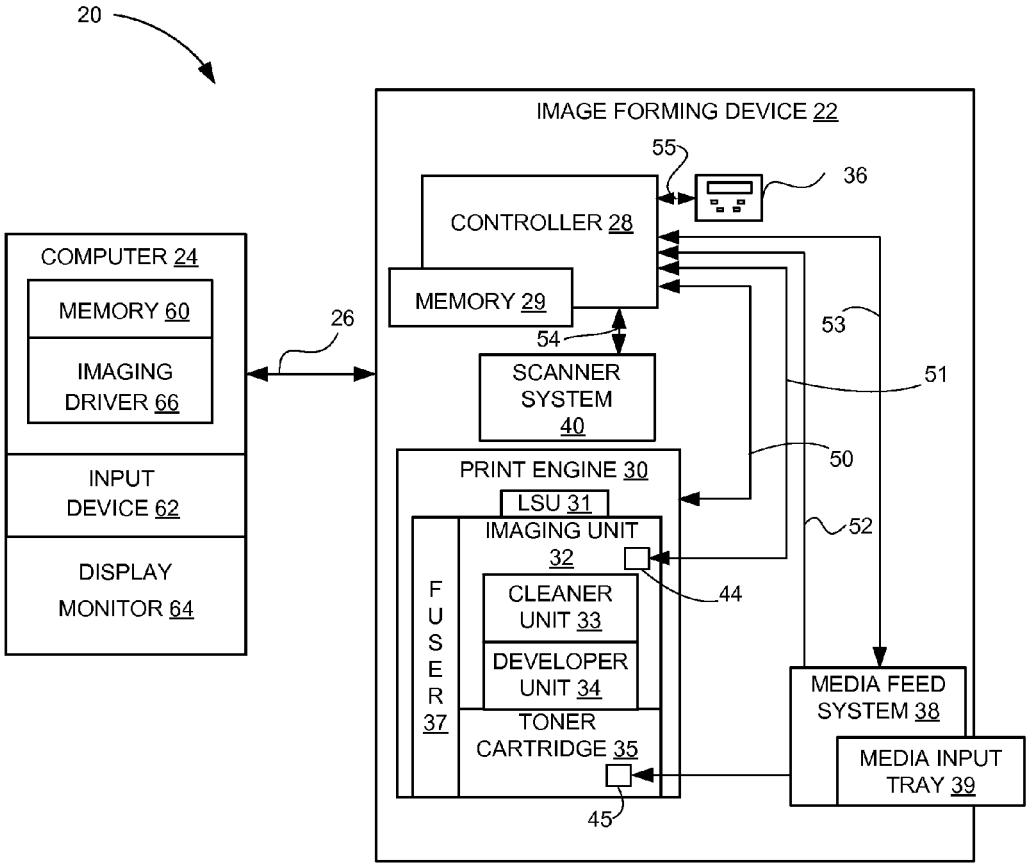
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or MD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 is removably mounted in image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging forming device 22 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received by imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, stapler or a hole-punch.

Figure 2:
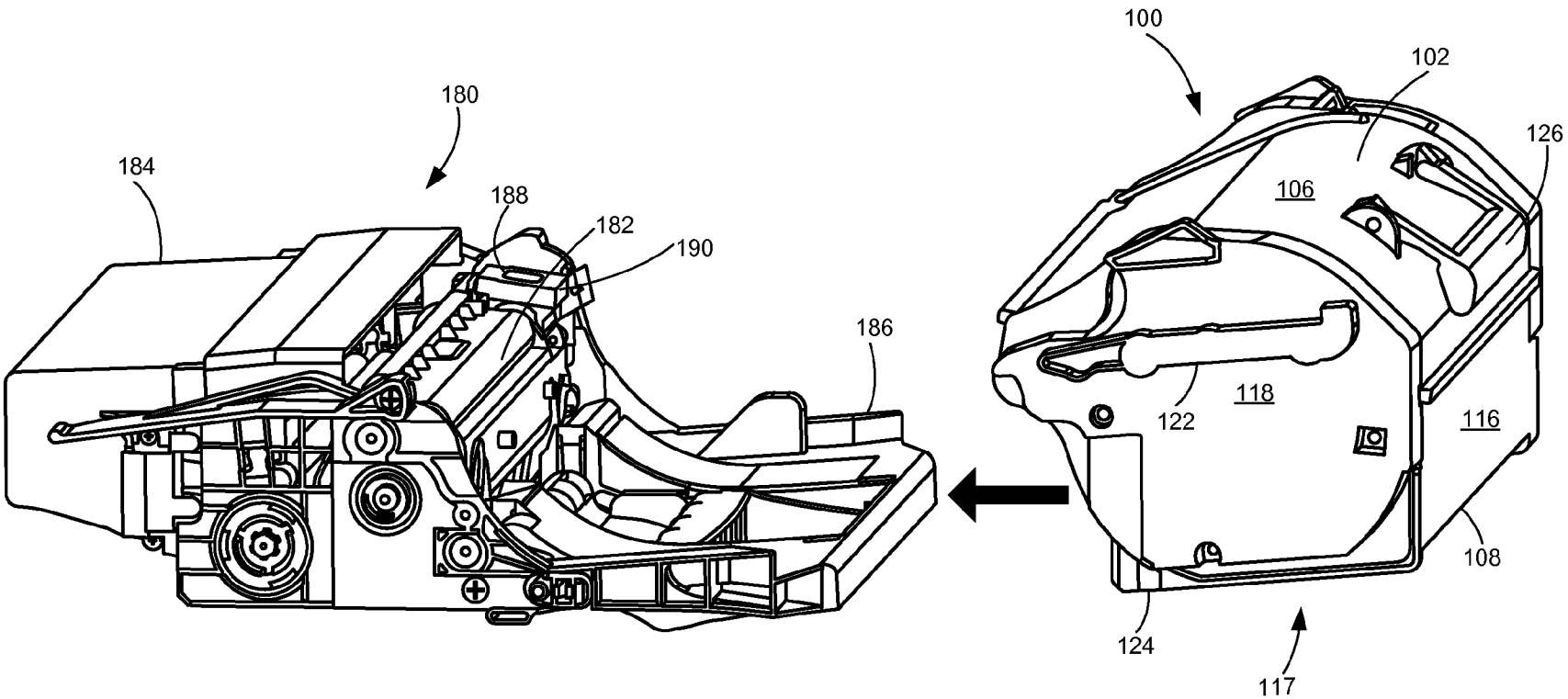
FIG. 2 is a perspective view of a toner cartridge and an imaging unit according to one example embodiment.
Figure 3:
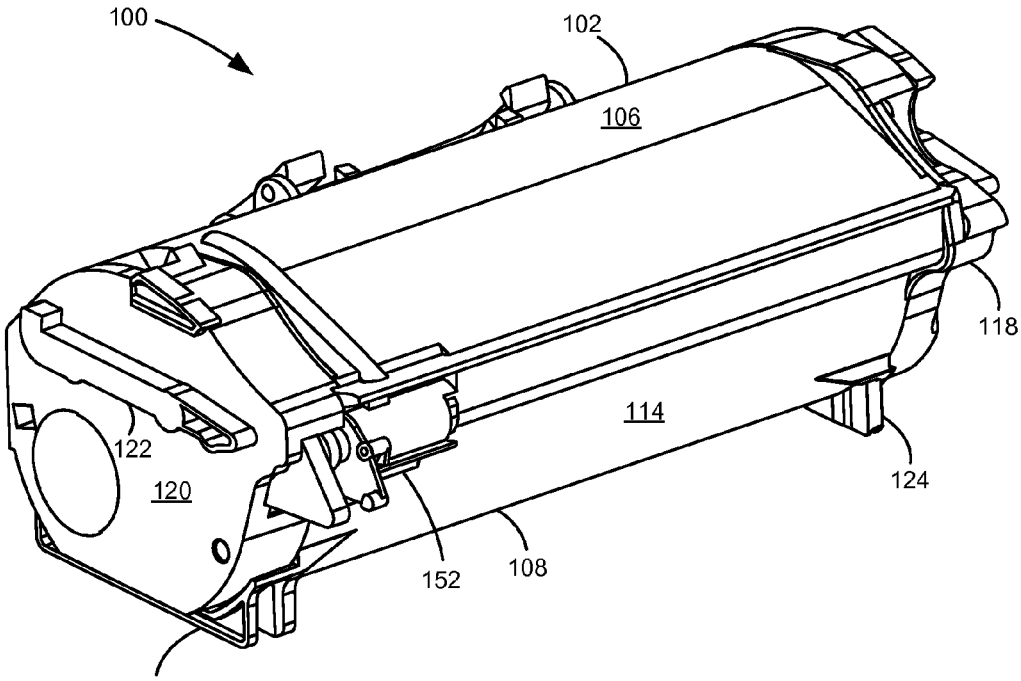
FIGS. 3 and 4 are additional perspective views of the toner cartridge shown in FIG. 2.
Figure 4:
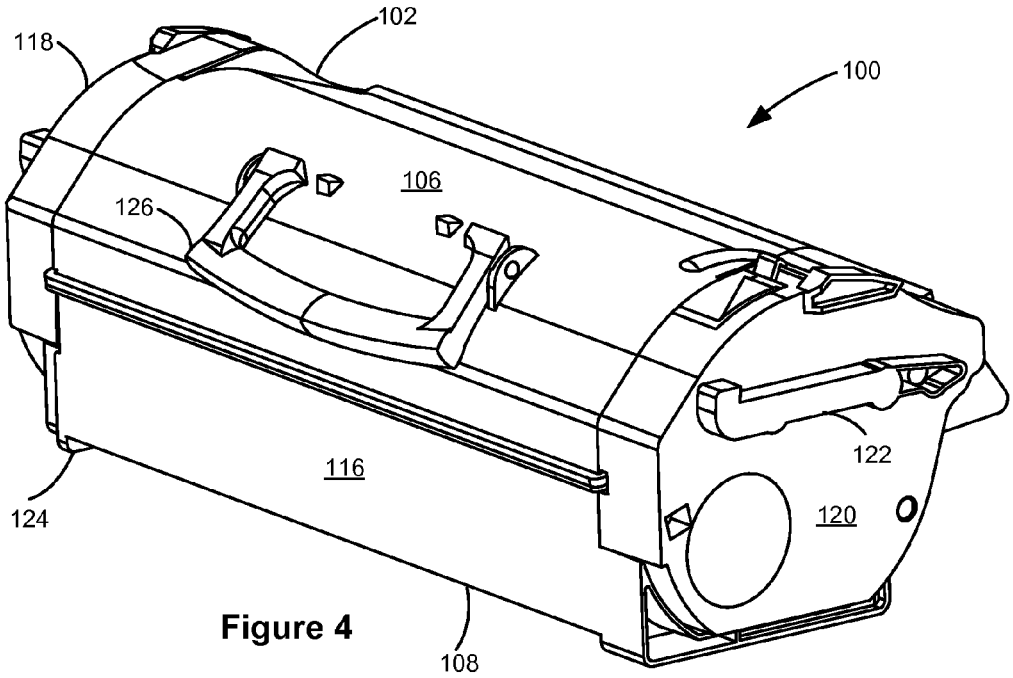

Referring now to FIG. 2, a toner cartridge 100 and an imaging unit 180 are shown according to one example embodiment. Imaging unit 180 includes a developer unit 182 and a cleaner unit 184 mounted on a common frame 186. As discussed above, imaging unit 180 and toner cartridge 100 are each removably installed in image forming device 22. Imaging unit 180 is first slidably inserted into image forming device 22. Toner cartridge 100 is then inserted into image forming device 22 and onto frame 186 in a mating relationship with developer unit 182 of imaging unit 180 as indicated by the arrow shown in FIG. 2. This arrangement allows toner cartridge 100 to be removed and reinserted easily when replacing an empty toner cartridge 100 without having to remove imaging unit 180. Imaging unit 180 may also be readily removed as desired in order to maintain, repair or replace the components associated with developer unit 182, cleaner unit 184 or frame 186 or to clear a media jam.

With reference to FIGS. 2-5, toner cartridge 100 includes a housing 102 having an enclosed reservoir 104 (FIG. 5) for holding a quantity of toner therein. Housing 102 may be viewed as having a top or lid 106 mounted on a base 108. Base 108 includes first and second side walls 110, 112 connected to adjoining front and rear walls 114, 116 and a bottom 117. In one embodiment, top 106 is ultrasonically welded to base 108 thereby forming enclosed reservoir 104. First and second end caps 118, 120 are mounted to side walls 110, 112, respectively, and include guides 122 to assist the insertion of toner cartridge 100 into image forming device 22 for mating with developer unit 182. First and second end caps 118, 120 may be snap fitted into place or attached by screws or other fasteners. Guides 122 travel in corresponding channels within image forming device 22. Legs 124 may also be provided on bottom 117 of base 106 or end caps 118, 120 to assist with the insertion of toner cartridge 100 into image forming device 22. Legs 124 are received by frame 186 to facilitate the mating of toner cartridge 100 with developer unit 182. A handle 126 may be provided on top 106 or base 108 of toner cartridge 100 to assist with insertion and removal of toner cartridge 100 from imaging unit 180 and image forming device 22. As shown in FIG. 6, a fill port 128 is provided on side wall 112 that is used to fill toner cartridge 100 with toner. After filling, fill port 128 is closed by a plug 130 and/or cap 132.

Figure 5:
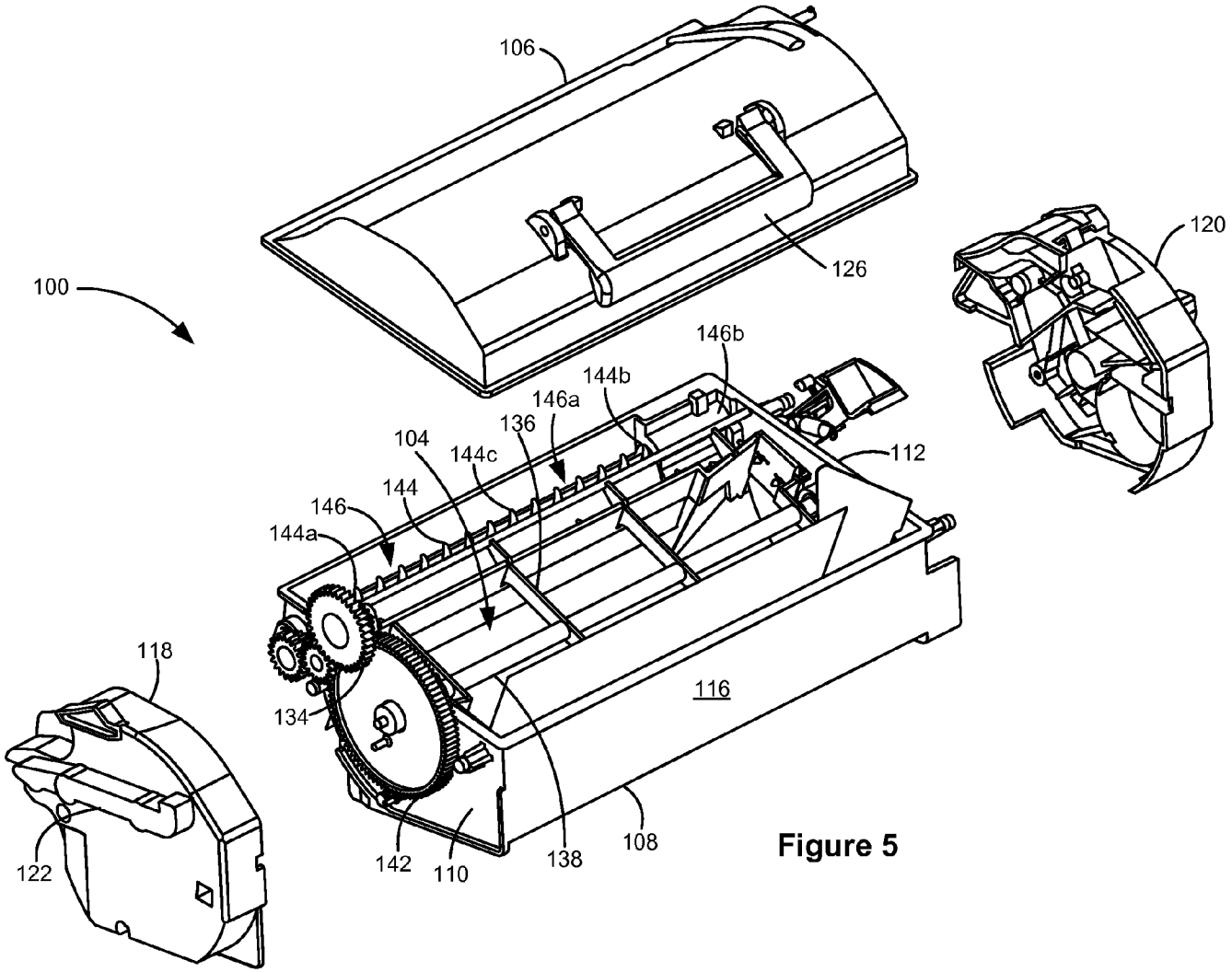
FIGS. 5 and 6 are exploded views of the toner cartridge shown in FIG. 2 showing a reservoir for holding toner therein.
Figure 6:
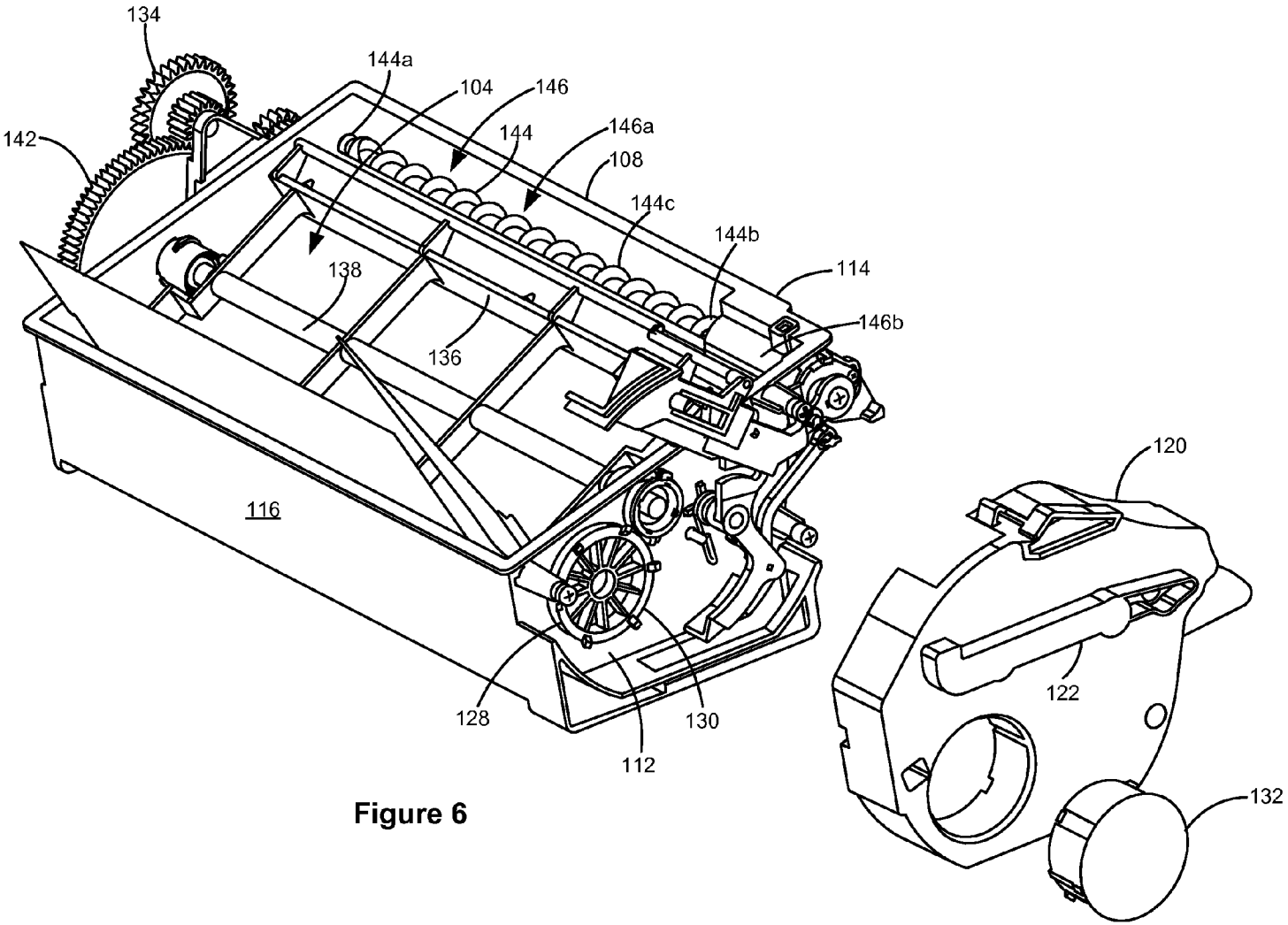

With reference to FIG. 5, various drive gears are housed within a space formed between end cap 118 and side wall 110. A main interface gear 134 engages with a drive system in image forming device 22 that provides torque to main interface gear 134. Various linkages are housed within a space formed between end cap 120 and side wall 112. One or more agitators or paddles 136 are rotatably mounted within toner reservoir 104 with first and second ends of a drive shaft 138 of paddle(s) 136 extending through aligned openings in side walls 110, 112, respectively. A drive gear 142 is provided on the first end of drive shaft 138 that engages with main interface gear 134 either directly or via one or more intermediate gears. Bushings may be provided on each end of drive shaft 138 where it passes through side walls 110, 112. Accordingly, side wall 110 may also be termed the "drive" or "driven" side of toner cartridge 100.

With reference to FIGS. 5 and 6, an auger 144 having first and second ends 144*a*, 144*b*, and a spiral screw flight 144*c* is positioned in a channel 146 extending along the width of front wall 114 between side walls 110, 112. Channel 146 may be integrally molded as part of front wall 114 or formed as a separate component that is attached to front wall 114. Channel 146 is generally horizontal in orientation along with toner cartridge 100 when toner cartridge 100 is installed in image forming device 22. First end 144*a* of auger 144 extends through side wall 110 and a drive gear (not shown) is provided on first end 144*a* that engages with main interface gear 134 either directly or via one or more intermediate gears. Channel 146 includes an open portion 146*a* and an enclosed portion 146*b*. Open portion 146*a* is open to toner reservoir 104 and extends from side wall 110 toward second end 144*b* of auger 144. Enclosed portion 146*b* of channel 146 extends from side wall 112 and encloses an optional shutter 150 (FIG. 7) and second end 144*b* of auger 144. As paddle(s) 136 rotate, they deliver toner from toner reservoir 104 into open portion 146*a* of channel 146. Auger 144 is rotated via its drive gear to deliver toner received in channel 146 to shutter 150.

Figure 7:
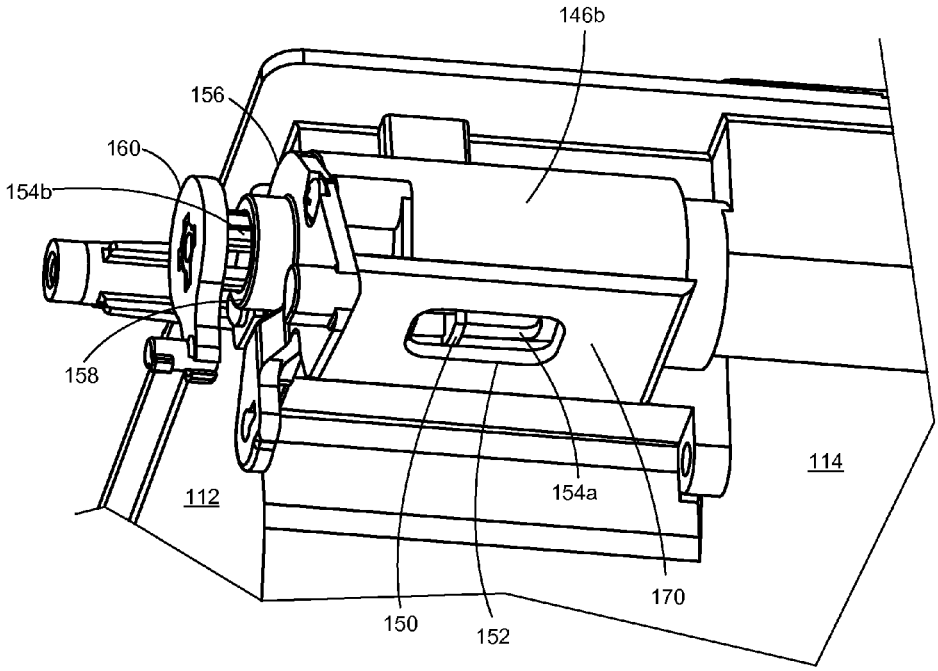
FIG. 7 is a perspective view of a front portion of the toner cartridge shown in FIG. 2 showing an exit port thereof.

With reference to FIG. 7, shutter 150 regulates whether toner is permitted to exit toner cartridge 100 through an exit port 152 provided in front wall 114. Exit port 152 is disposed at the bottom of channel 146 so that gravity will assist in exiting toner through exit port 152. Shutter 150 is rotatable between a closed position and an open position. Shutter 150 includes an open end (not shown) that receives second end 144*b* of auger 144. As auger 144 rotates, it delivers toner from channel 146 into the open end of shutter 150. Shutter 150 also includes a radial opening 154*a* that is connected to the open end of shutter 150 by an internal channel in shutter 150. A retaining member 156 is mounted on side wall 112 of toner cartridge 100. In the example embodiment illustrated, retaining member 156 is a separate component attached to housing 102; however, retaining member 156 may also be integrally molded as part of housing 102. Retaining member 156 includes a bushing 158 that receives a closed end 154*b* of shutter 150. Closed end 154*b* of shutter 150 is connected to a lever 160 that opens and closes shutter 150.

When shutter 150 is in the open position, radial opening 154*a* is aligned with exit port 152 in order to permit toner to exit toner cartridge 100 through exit port 152. When shutter 150 is open, toner may be delivered from reservoir 104 of toner cartridge 100 to imaging unit 180 by rotating paddle(s) 136 and auger 144 as desired. Specifically, as paddle(s) 136 rotate, they deliver toner from toner reservoir 104 into open portion 146*a* of channel 146. As auger 144 rotates, it delivers toner received in channel 146 into the open end of shutter 150. Toner passes through the internal channel in shutter 150 and out of radial opening 154*a* and exit port 152 into a corresponding entrance port 188 in developer unit 182 (FIG. 2). In one embodiment, entrance port 188 of developer unit 182 is surrounded by a foam seal 190 that soaks up residual toner and prevents toner leakage at the interface between exit port 152 and entrance port 188. When shutter 150 is in the closed position, radial opening 154*a* is positioned against an internal surface of enclosed portion 146*b* of channel 146 in order to prevent toner from exiting toner cartridge 100.

Lever 160 may be rotated to open or close shutter 150 by any suitable method known in the art. For example, it will be appreciated that shutter 150 preferably remains closed unless toner cartridge 100 is installed in image forming device 22. Accordingly, in one embodiment, lever 160 and shutter 150 are biased toward the closed position by a biasing member such as a spring. Lever 160 and shutter 150 may be rotated to the open position as toner cartridge 100 reaches its final position in image forming device 22 by an opposing force provided by an element on imaging unit 180 or image forming device 22. For example, a pin or other type of projection on imaging unit 180 or image forming device 22 may engage lever 160 or a mechanical linkage thereto to rotate lever 160 as toner cartridge 100 reaches its final position. Further, lever 160 and shutter 150 may be rotated to the open position when a door in image forming device 22 permitting access to toner cartridge 100 is closed. For example, a plunger or other projection extending from an internal portion of the door may engage lever 160 or a mechanical linkage thereto to provide the opposing force. A combination of these methods may also be used as desired. Lever 160 may also be rotated by a solenoid or drive transmission provided on side wall 112 of toner cartridge 100. The solenoid or drive transmission may be actuated by a drive mechanism in image forming device 22.

Figure 8:
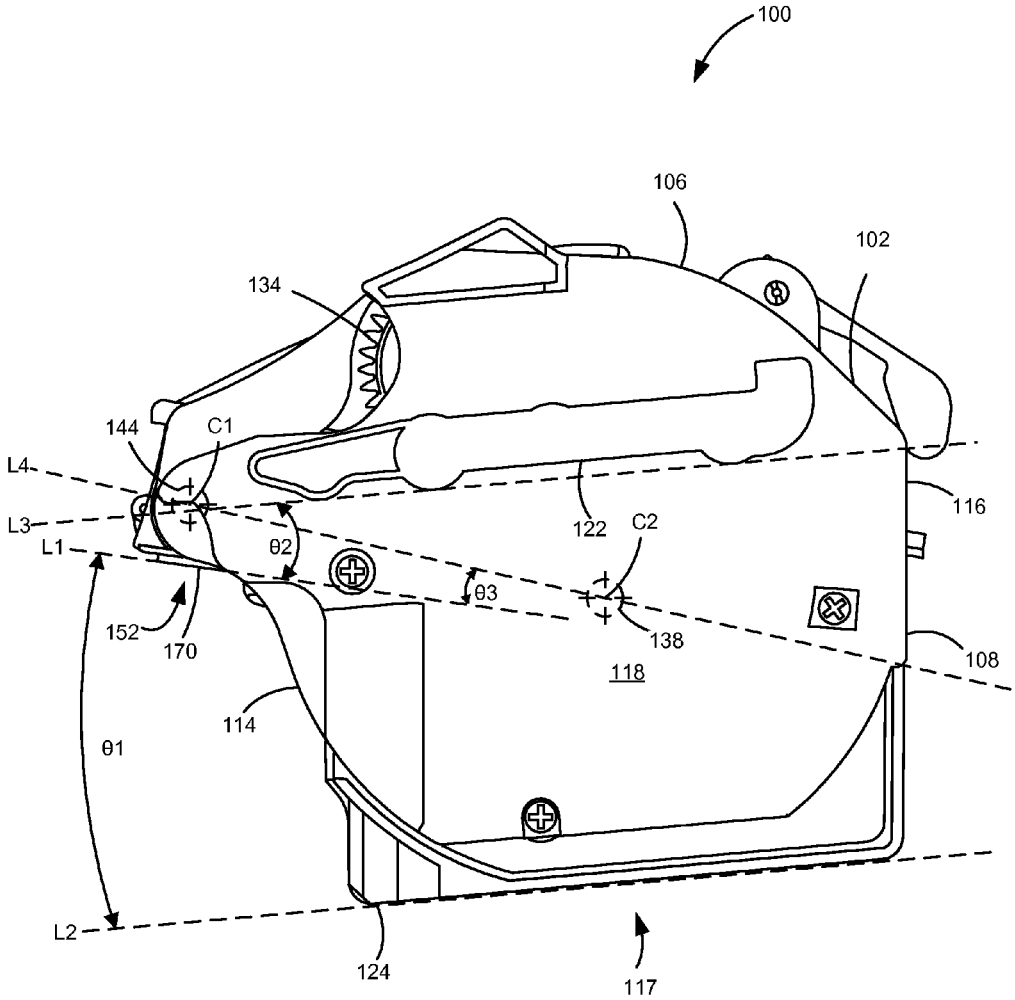
FIG. 8 is a side elevation view of the toner cartridge shown in FIG. 2 illustrating an angled exit port surface according to one example embodiment.

Exit port 152 is surrounded by a port surface 170 on front 114 of toner cartridge 100. In one embodiment, port surface 170 is substantially planar. Port surface 170 mates against foam seal 190 when toner cartridge 100 mates with developer unit 182 to prevent toner from leaking as it passes from exit port 152 of toner cartridge 100 to entrance port 188 of developer unit 182. With reference to FIG. 8, port surface 170 is angled upward and faces generally downward. The orientation of port surface 170 is represented in FIG. 8 by line L1. In one embodiment, port surface 170 is angled upward with respect to bottom 117 of housing 102, such as the bottom of legs 124, by an angle Θ1 of between about 3° and about 23° including all values and increments therebetween such as, for example, between about 3° and about 17°, between about 9° and about 23°, between about 9° and about 17°, between about 15° and about 23°, between about 11° and about 15©, between about 17° and about 21°, or an angle Θ1 of about 13° or about 19°. The orientation of bottom 117 of housing 102 is represented in FIG. 8 by line L2. In one embodiment, port surface 170 is angled upward with respect to a bottom surface of wing guide 122 by an angle Θ2 of between about 3° and about 23° including all values and increments therebetween such as, for example, between about 3° and about 17°, between about 9° and about 23°, between about 9° and about 17°, between about 15° and about 23°, between about 11° and about 15°, between about 17° and about 21°, or an angle Θ2 of about 13° or about 19°. The orientation of wing guide 122 is represented in FIG. 8 by line L3. In the example embodiment illustrated, the bottom surface of wing guide 122 is substantially parallel with bottom 117 of housing 102. In one embodiment, port surface 170 is angled with respect to a line formed between a centerline C1 of auger 144 and a centerline C2 of drive shaft 138 (represented in FIG. 8 by line L4) by an angle Θ3 of between about 3° upward with respect to line L4 and about 14° downward with respect to line L4 including all values and increments therebetween such as, for example, between about 3° upward with respect to line L4 and about 11° downward with respect to line L4, between about 0° with respect to line L4 and about 14° downward with respect to line L4, between about 3° upward with respect to line L4 and about 5° downward with respect to line L4, between about 0° with respect to line L4 and about 8° downward with respect to line L4, between about 1° upward with respect to line L4 and about 3° downward with respect to line L4, between about 2° downward with respect to line L4 and about 6° downward with respect to line L4, or an angle Θ3 of about 1° downward or about 4° downward with respect to line L4.

Figure 9:
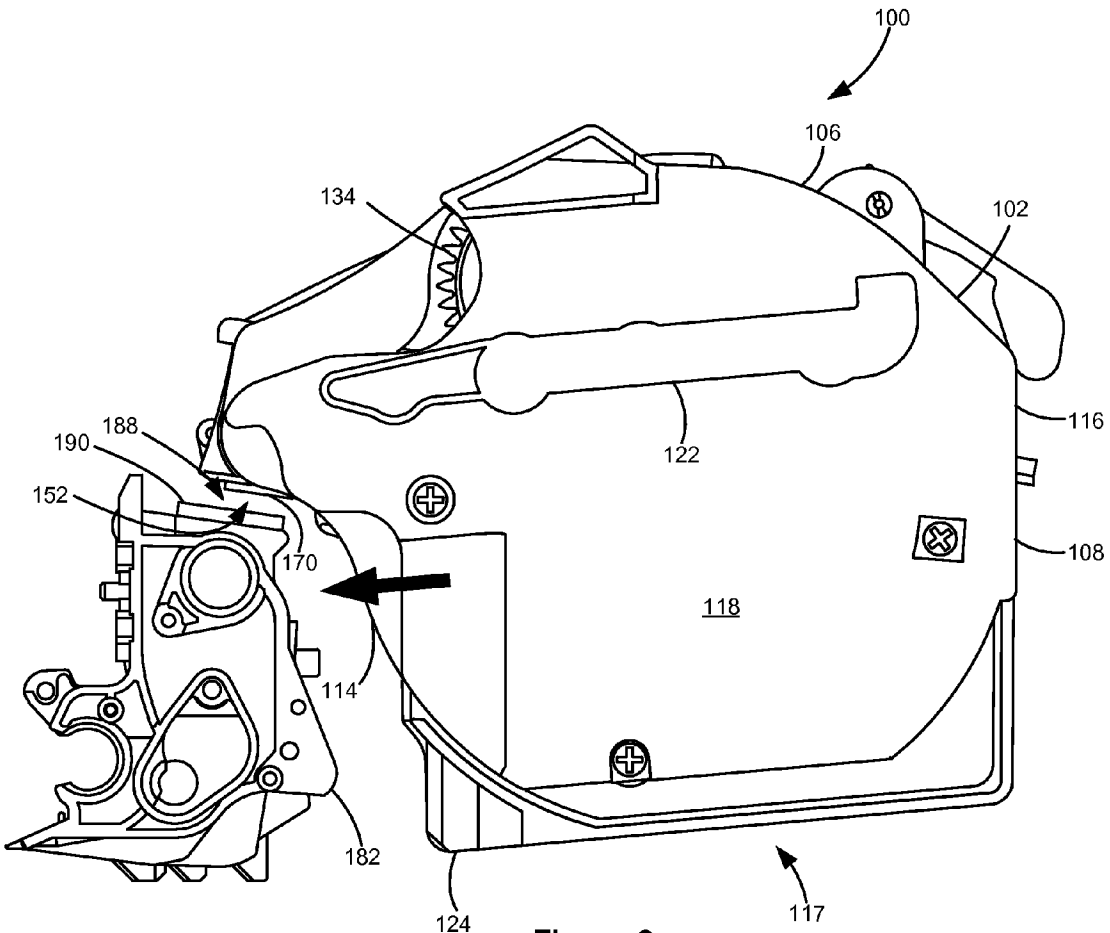
FIGS. 9 and 10 are sequential side elevation views of the toner cartridge shown in FIG. 8 mating with a developer unit according to one example embodiment.
Figure 10:
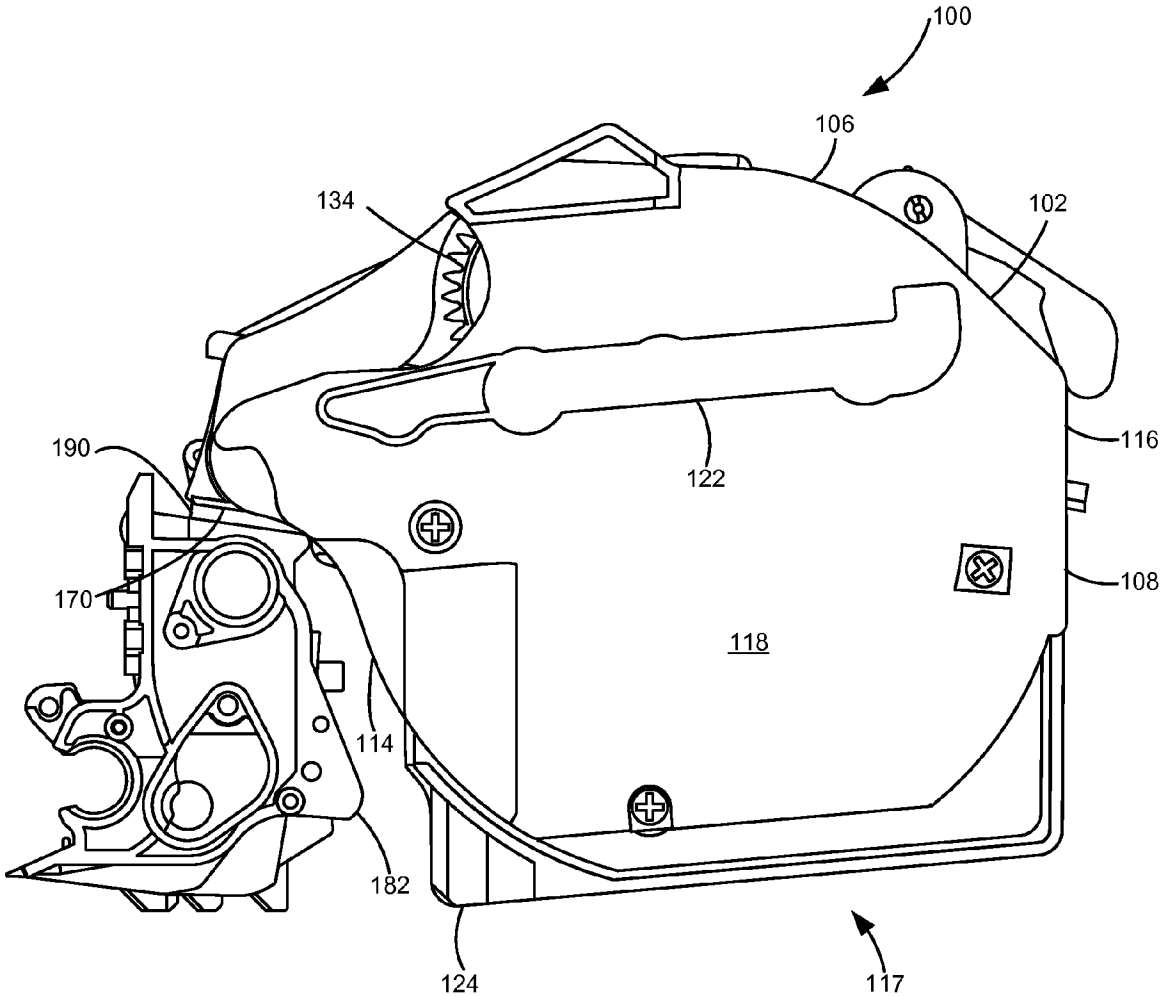

The angle of port surface 170 ensures proper seating of port surface 170 on seal 190 of entrance port 188 on developer unit 182. FIG. 9 shows toner cartridge 100 as it approaches developer unit 182 along a generally horizontal entry path during insertion of toner cartridge 100 into image forming device 22. The angle of port surface 170 causes port surface 170 to lower onto seal 190 as toner cartridge 100 reaches its final position instead of shearing horizontally across the top surface of seal 190. This allows port surface 170 to form a tight seal with seal 190 around the interface between exit port 152 of toner cartridge and entrance port 188 of developer unit 182. If instead port surface 170 traveled across seal 190 horizontally along the direction of insertion of toner cartridge 100, port surface 170 may tend to tear or rip seal 190 leaving seal 190 susceptible to toner leakage. The angled approach by port surface 170 also reduces the force applied on developer unit 182 by toner cartridge 100. It will be appreciated that developer unit 182 is precisely aligned to ensure proper toner transfer from the toner sump therein to the photoconductive drum housed in cleaner unit 184. Print defects and/or photoconductive drum wear may occur if this alignment is disturbed, such as by excessive force applied by port surface 170 on developer unit 182. FIG. 10 shows toner cartridge 100 in its final position mated with developer unit 182. As shown, in this position, port surface 170 is mated against seal 190 to prevent toner leakage.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A toner cartridge for an electrophotographic image forming device, comprising:

a housing having a top, a bottom, a front, and a rear positioned between a first side and a second side of the housing, the housing defining a reservoir for containing toner therein;

an exit port on the front of the housing in fluid communication with the reservoir; and a port surface surrounding the exit port positioned to seal against a corresponding surface when the toner cartridge is installed in the image forming device, the port surface being angled upward with respect to the bottom of the housing and facing generally downward and facing forward with respect to the front of the housing, wherein the port surface is angled upward with respect to the bottom of the housing by between about 3 degrees and about 23 degrees.

2. The toner cartridge of claim 1, wherein the port surface is substantially planar.

3. The toner cartridge of claim 1, wherein the port surface is angled upward with respect to the bottom of the housing by between about 3 degrees and about 17 degrees.

4. The toner cartridge of claim 3, wherein the port surface is angled upward with respect to the bottom of the housing by about 13 degrees.

5. The toner cartridge of claim 1, wherein the port surface is angled upward with respect to the bottom of the housing by between about 9 degrees and about 23 degrees.

6. The toner cartridge of claim 5, wherein the port surface is angled upward with respect to the bottom of the housing by about 19 degrees.

7. The toner cartridge of claim 1, further comprising at least one leg projecting from the bottom of the housing and extending along a front-to-rear dimension of the housing, wherein the port surface is angled upward with respect to a bottom of the at least one leg by between about 3 degrees and about 23 degrees.

8. The toner cartridge of claim 1, further comprising a guide on at least one of the first side and the second side of the housing positioned to guide insertion of the toner cartridge into the image forming device, wherein the port surface is angled upward with respect to the at least one guide by between about 3 degrees and about 23 degrees.

9. A toner cartridge for an electrophotographic image forming device, comprising:

a housing having a top, a bottom, a front, and a rear positioned between a first side and a second side of the housing, the housing having an elongated shape extending from the first side to the second side, the housing defining a reservoir for containing toner therein;

a rotatable shaft positioned within the reservoir and extending between the first side and the second side;

at least one agitator extending from the rotatable shaft for agitating toner within the reservoir;

a channel open to the reservoir and positioned on the front of the housing extending between the first side and the second side;

an exit port on the front of the housing in fluid communication with the channel;

a rotatable auger positioned along a length of the channel for moving toner from the reservoir to the exit port; and a port surface surrounding the exit port positioned to seal against a corresponding surface when the toner cartridge is installed in the image forming device, wherein the port surface is angled with respect to a line formed by a centerline of the rotatable shaft and a centerline of the rotatable auger by between about 3 degrees upward with respect to said line and about 14 degrees downward with respect to said line and the port surface is angled upward with respect to the bottom of the housing.

10. The toner cartridge of claim 9, wherein the port surface is angled by between about 3 degrees upward with respect to said line formed by the centerline of the rotatable shaft and the centerline of the rotatable auger and about 11 degrees downward with respect to said line.

11. The toner cartridge of claim 10, wherein the port surface is angled by between about 3 degrees upward with respect to said line formed by the centerline of the rotatable shaft and the centerline of the rotatable auger and about 5 degrees downward with respect to said line.

12. The toner cartridge of claim 11, wherein the port surface is angled by about 1 degree downward with respect to said line formed by the centerline of the rotatable shaft and the centerline of the rotatable auger.

13. The toner cartridge of claim 9, wherein the port surface is angled by between about 0 degrees with respect to said line formed by the centerline of the rotatable shaft and the centerline of the rotatable auger and about 14 degrees downward with respect to said line.

14. The toner cartridge of claim 13, wherein the port surface is angled by between about 0 degrees with respect to said line formed by the centerline of the rotatable shaft and the centerline of the rotatable auger and about 8 degrees downward with respect to said line.

15. The toner cartridge of claim 14, wherein the port surface is angled by about 4 degrees downward with respect to said line formed by the centerline of the rotatable shaft and the centerline of the rotatable auger.

16. The toner cartridge of claim 9, wherein the port surface is angled upward with respect to the bottom of the housing by between about 3 degrees and about 23 degrees.

17. The toner cartridge of claim 9, further comprising at least one leg projecting from the bottom of the housing and extending along a front-to-rear dimension of the housing, wherein the port surface is angled upward with respect to a bottom of the at least one leg by between about 3 degrees and about 23 degrees.

18. The toner cartridge of claim 9, further comprising a guide on at least one of the first side and the second side of the housing positioned to guide insertion of the toner cartridge into the image forming device, wherein the port surface is angled upward with respect to the at least one guide by between about 3 degrees and about 23 degrees.

19. A toner cartridge for an electrophotographic image forming device, comprising:

a housing having a top, a bottom, a front, and a rear positioned between a first side and a second side of the housing, the housing defining a reservoir for containing toner therein;

an exit port on the front of the housing in fluid communication with the reservoir; and a port surface surrounding the exit port positioned to seal against a corresponding surface when the toner cartridge is installed in the image forming device, the port surface being angled upward with respect to the bottom of the housing and facing generally downward and facing forward with respect to the front of the housing, further comprising at least one leg projecting from the bottom of the housing and extending along a front-to-rear dimension of the housing, wherein the port surface is angled upward with respect to a bottom of the at least one leg by between about 3 degrees and about 23 degrees.

20. A toner cartridge for an electrophotographic image forming device, comprising:

a housing having a top, a bottom, a front, and a rear positioned between a first side and a second side of the housing, the housing defining a reservoir for containing toner therein;

an exit port on the front of the housing in fluid communication with the reservoir; and a port surface surrounding the exit port positioned to seal against a corresponding surface when the toner cartridge is installed in the image forming device, the port surface being angled upward with respect to the bottom of the housing and facing generally downward and facing forward with respect to the front of the housing, further comprising a guide on at least one of the first side and the second side of the housing positioned to guide insertion of the toner cartridge into the image forming device, wherein the port surface is angled upward with respect to the at least one guide by between about 3 degrees and about 23 degrees.

* * * * *